United States Patent [19]

Aka et al.

[11] 4,258,533

[45] Mar. 31, 1981

[54] APPARATUS FOR FITTING SHRUNK ON-FOIL HOODS INTO RECESSED PORTIONS OF A MULTI-LAYERED STACK

[75] Inventors: Peter Aka; Manfred Grünert, both of Beckum, Fed. Rep. of Germany

[73] Assignee: Möllers Maschinenfabrik GmbH, Beckum, Fed. Rep. of Germany

[21] Appl. No.: 7

[22] Filed: Jan. 2, 1979

[30] Foreign Application Priority Data

Feb. 18, 1978 [DE] Fed. Rep. of Germany ... 7804967[U]

[51] Int. Cl.[3] ..... B65B 53/06

[52] U.S. Cl. ..... 53/557

[58] Field of Search ..... 53/557, 442; 264/230

[56] References Cited

U.S. PATENT DOCUMENTS

| | | | |
|---|---|---|---|
| 3,508,375 | 4/1970 | Myers | 53/442 |
| 3,581,458 | 6/1971 | Gustavsson | 53/442 |
| 3,853,218 | 12/1974 | Grasvoll | 53/442 |
| 3,895,476 | 7/1975 | Burns | 53/442 |
| 3,897,671 | 8/1975 | Higgins | 53/442 |
| 3,903,673 | 9/1975 | Grasvoll | 53/557 |
| 3,958,392 | 5/1976 | Beninger | 53/442 |
| 3,999,357 | 12/1976 | Marantz | 53/442 |
| 4,060,957 | 12/1977 | Birkenfeld et al. | 53/442 |

OTHER PUBLICATIONS

Möllers palettenlose Paketierung nach dem Konterhauben—Schrumpf System.

Palettenloses Paketieren nach dem Konterhauben—Prinzip, neue verpackung, 3/1977, pp. 268–281.

*Primary Examiner*—Thomas P. Pavelko

*Attorney, Agent, or Firm*—Toren, McGeady and Stanger

[57] ABSTRACT

The opposite sides of the bottom layer of a multi-layered stack of packages have recessed portions. In apparatus for fitting a shrunk-on foil hood over the stack, a conveyor is positioned at a working station. The conveyor can be raised and lowered. After the stack is positioned at the working station, the conveyor is lowered and sets of rollers at each end of the conveyor are moved horizontally inwardly above the conveyor into the recessed portions of the stack. With the rollers within the recessed portions, the conveyor is lowered further so that the rollers contact the downwardly facing surface of the recessed portion. The relative movement of the sets of rollers and the conveyor permit the rollers to press the foil hood into closely fitting contact with the recessed portions of the stack. While the foil hood is pressed into the recessed portions, cooling air can be directed toward the stack to facilitate the shrinking action.

12 Claims, 7 Drawing Figures

FIG. 6
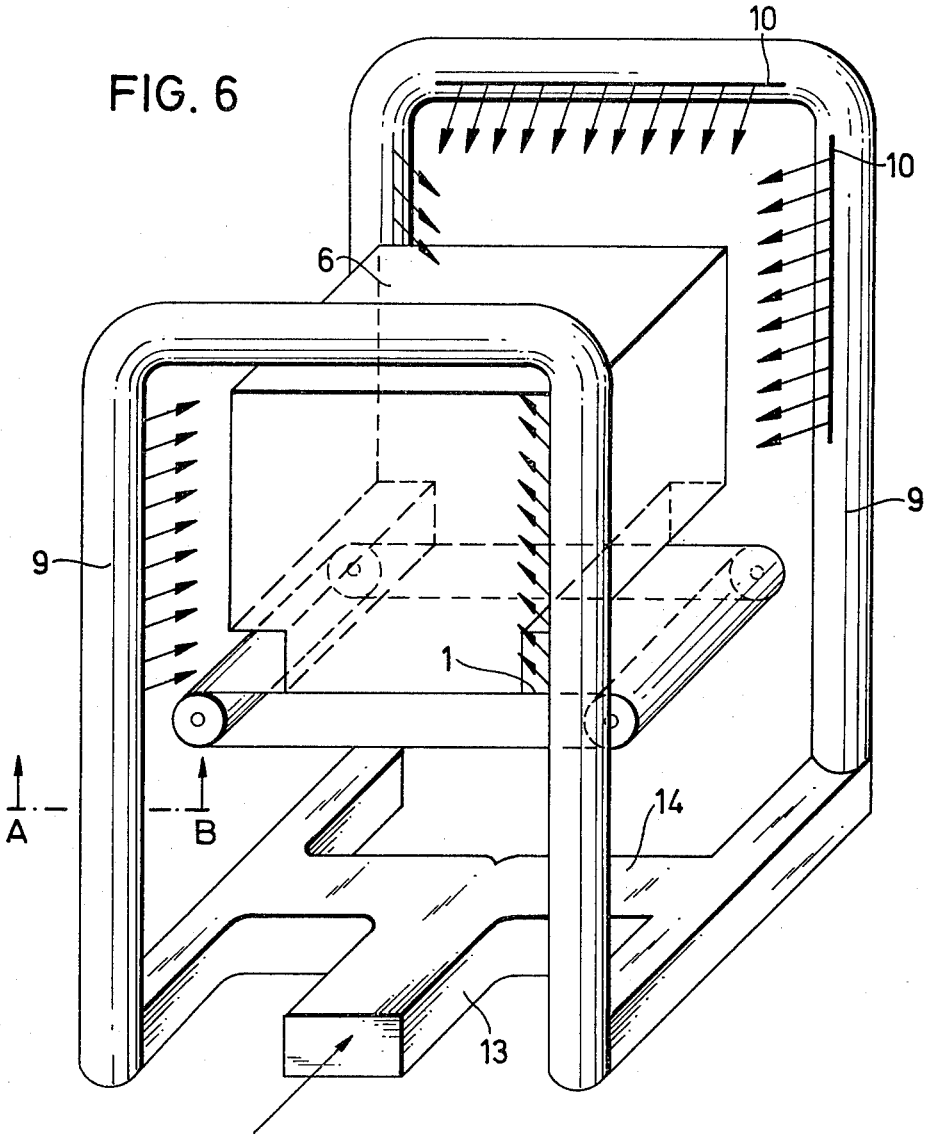
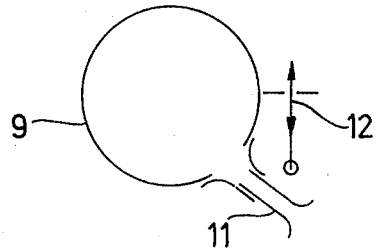
FIG. 7

APPARATUS FOR FITTING SHRUNK ON-FOIL HOODS INTO RECESSED PORTIONS OF A MULTI-LAYERED STACK

SUMMARY OF THE INVENTION

The present invention is directed to apparatus for fitting a shrunk-on foil hood onto a multi-layered stack of packages and, more particularly, it is directed to fitting the foil hood into recessed portions in the stack. The recessed portions are located along two opposite sides of the bottom layer of the stack. The prongs or arms of a forklift can be inserted into the recessed portions for lifting the stack. The apparatus includes a conveyor which can be moved vertically by the height of the bottom layer of the stack.

In known apparatus of this type as disclosed in German Patent Application 27 02 613.7-27, a conveyor is provided at its front end as viewed in the conveying direction with a stop ledge extending transversely of the conveying direction. The stop ledge can be lowered after the bottom recessed layer of the stack contacts the stop ledge. The ledge is lowered below the normal level at which the stack is conveyed. At the rearward end of the conveyor in the direction of its movement, a pressing plate is provided which in the lowered state of the stack can be swung about its lower edge and pressed against the bottom layer of the stack. This construction always requires an exact adjustment to the dimensions of the stack being handled, or it requires different equipment when the stack dimensions change. Moreover, the formation of the hood portions about the stack is not considered satisfactory, particularly in forming the hood around the bottom of the first layer of the stack above the recessed bottom layer.

Therefore, it is the primary object of the present invention to provide apparatus which ensures an automatic adjustment to stacks of different dimensions as well as affording an improved shaping of the foil hood, particularly with respect to pressing the hood portions against the undersurface of the first standard layer of the stack above the recessed bottom layer.

In accordance with the present invention, a conveyor is provided between two other conveyors and, between the adjacent ends of the conveyors, sets of rollers are arranged which can be moved horizontally into contact with the recessed bottom layer after the conveyor has been lowered at least by the diameter or height of the rollers. With the rollers located within the recessed portions, the conveyor can be further lowered until the rollers contact the undersurface of the layer above the recessed bottom layer.

Because of the arrangement of this apparatus, it is possible to move the sets of rollers inwardly into the recessed portions of the bottom layer even in stacks where the bottom layers have different dimensions with the inward movement of the rollers taking place uniformly into both recessed portions. When the conveyor surpporting the stack is lowered further, the foil hood is effectively pressed against the downwardly facing surface of the recessed portion, that is the undersurface of the first layer above the recessed bottom layer, and, if necessary, the portions of the foil hood pulled downwardly over the stack can be easily welded to a previously applied hood which had been placed over the stack from the opposite end.

Another preferred feature of the present invention is the provision of cooling air members which can be actuated when the sets of rollers are moved into the recessed portions of the bottom layer so that a uniform and rapid cooling takes place, particularly for the portions of the foil hood formed inwardly into the recessed portions of the stack.

The cooling air members can be provided in the form of air slots in the inverted U-shaped support frames of tubular cross-section which support the conveyor so that it can be moved vertically. Accordingly, such frames have a double function, on one hand, they act as support frames for the vertically adjustable support of the conveyor and, on the other hand, they act as members for supplying the cooling air to the air slots. Such apparatus affords an especially compact, inexpensive and space-spacing arrangement. Further, the air slots can advantageously be provided with adjustable nozzles for adjusting to various stack dimensions. Finally, a preferred arrangement is afforded when the cooling air is supplied into the lower ends of the legs of the U-shaped frame.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 6 is a perspective schematic view of the apparatus embodying the present invention; and FIG. 7 is a section line taken along the line A—B in FIG. 6.

DETAILED DESCRIPTION OF THE DRAWING

Figure 1:
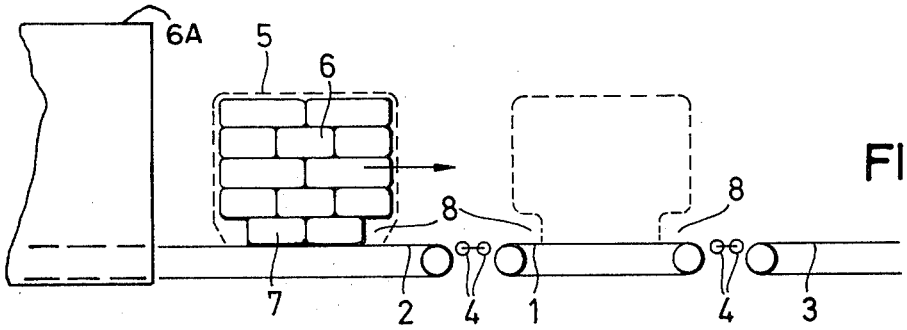
FIGS. 1–5 afford a schematic representation of the steps involved in the operation of the apparatus embodying the present invention.

In FIG. 1, the apparatus illustrated includes a vertically movable conveyor 1 located between two other conveyors 2, 3. The ends of the conveyors 2, 3 adjacent to the respective ends of the conveyor 1 are spaced apart and a set of rollers 4 is provided between each pair of adjacent ends. Each set of rollers can be moved in the horizontal direction in opposite directions relative to one another as explained in the following description.

The apparatus illustrated in FIGS. 1–5 operates as follows

A multi-layered stack 6 of packages is positioned on the conveyor 2 and is covered by a shrunk-on foil hood 5. The bottom layer of the stack has recessed portions on the opposite sides of the layer in the direction of movement of the conveyors. The recessed portions 8 are arranged to receive the arms or prongs of a forklift for lifting the stack. While for the purpose of this description the recessed portions 8 are described as being in the bottom layer 7, it can be appreciated that more than one layer may be involved.

Figure 2:
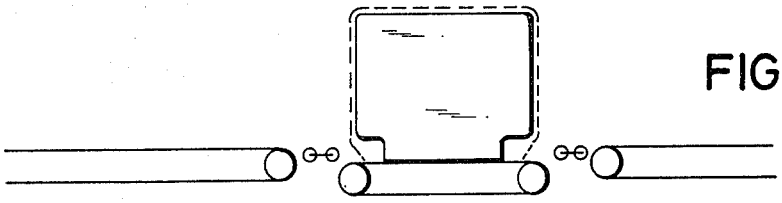
Figure 3:
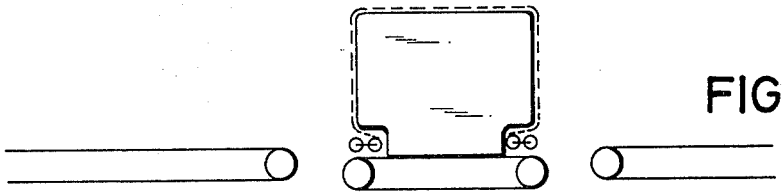
Figure 4:
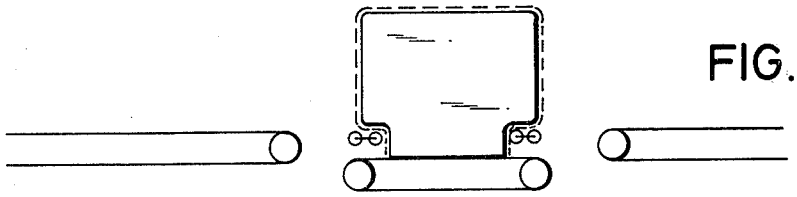
Figure 5:
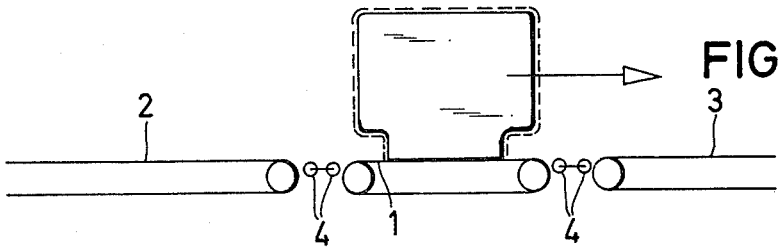

After the stack 6 has left an oven 6A for effecting the shrinking process, the foil hood 5 is already shrunk on to the stack 6 resting on the conveyor 2, so that the lower portions of the foil hood are partially drawn into the recessed portions 8. At this particular point, the shrunk-on foil hood is still in a plastic state as the stack is conveyed over the set of rollers 4 between conveyor 2 and conveyor 1 onto conveyor 1, note the position of the stack shown in dashed lines. Subsequently, as illustrated in FIG. 2, the conveyor 1 is lowered through a vertical distance at least equal to the height or diameter of the rollers 4. Initially, the uppermost or crown surface of the rollers is located approximately in the same plane as the upper surfaces of the conveyors 1, 2 and 3. With the conveyor lowered, the sets of rollers 4 are located above the upper or stack mounting surface of the conveyor 1 and are moved inwardly toward one another above the surface of the conveyor. The two sets of rollers are moved in opposite directions into the recessed portions formed in the bottom layer 7 of the stack, note FIG. 3. Subsequently, the conveyor is lowered even further so that the projecting or downwardly facing portions of the first standard sized layer of the stack 6 rests on each set of the rollers 4. The relative movement between the stack and the rollers presses or fits the foil hood against the surfaces of the stack forming the recessed portions 8. In the event another foil hood has been previously pulled upwardly over the bottom of the stack, a satisfactory welding between the two telescoping foil hoods is effected, note FIG. 4. Next, the sets of rollers 4 are moved outwardly out of the recessed portions 8 of the stack and the conveyor is moved vertically back to the original position shown in FIG. 1 so that its stack mounting surface is in the same plane with the other conveyors 2, 3, and the stack can be moved in the direction of the arrow shown in FIG. 5, onto the conveyor 3.

Cooling air supply members are provided to ensure that a quick and safe cooling of the foil hood is carried out so that the shaped configuration of the hood within the recessed portions 8 is maintained. As illustrated in FIGS. 6 and 7, the cooling air supply members are in the form of air slots 10 formed in the legs or uprights and the horizontal bight portion interconnecting the uprights of the inverted U-shaped support frames 9 for vertically movable conveyor 1.

The air slots are provided with adjustable nozzles which can be regulated by means of an adjustment device 12, shown schematically in FIG. 7, so that the air slots can be adjusted to the various dimensions of the stack being covered by a foil hood. The cooling air is supplied through a common supply conduit 13 into branch conduits 14 which convey the air to the lower ends of the legs or uprights of the U-shaped frames 9. It can be appreciated that the above-described embodiment incorporating the present invention can be varied in a number of ways without departing from the essence of the invention. For example, instead of vertically adjusting the conveyor, the sets of rollers could be both horizontally and vertically movable, however, the described embodiment has proven to be particularly advantageous. Conventional equipment can be used for moving the rollers 4 and the conveyor 1.

While specific embodiments of the invention have been shown and described in detail to illustrate the application of the inventive principles, it will be understood that the invention may be embodied otherwise without departing from such principles.

What is claimed is:

1. Apparatus for closely fitting a shrunk-on foil hood while the hood is still in the plastic state into recessed portions extending along a pair of opposite sides of a multi-layered stack of packages over which the hood is placed, the recessed portions being arranged to receive members for lifting the stack such as recessed portions formed in the bottom layer of a multi-layered stack where the two opposite sides of at least the bottom layer are recessed inwardly from the sides of the superposed layers and each recessed portion has a downwardly facing surface and an outwardly facing surface so that lifting members of a forklift can be inserted into the recessed portions into contact with the downwardly facing surfaces for lifting the stack, comprising first means for conveying the multi-layered stack with recessed portions along two opposite sides of at least the bottom layer generally in the horizontal direction to and from a working station, a heating unit upstream from the working station for heating the foil hood before the stack and hood are conveyed by said first means to the working station, second means for conveying the multi-layered stack in the same direction of said first means and for supporting the stack at the working station, said second means including a generally horizontal support surface for the stack located at the working station, wherein the improvement comprises two sets of rollers with one said set being located on an opposite side of said support surface from the other and being located on the opposite sides corresponding to the recessed opposite sides of the bottom layer and arranged to be rectilinearly movably positionable from a first position spaced laterally outward from said support surface to a second position inwardly over said support surface from the first position and into contact with the upwardly extending outwardly facing surfaces within the recessed portions of the stack for fitting the foil hood into shaped close engagement with the outwardly facing surfaces of the recessed portions, said second means being movable generally in the vertical direction relative to said sets of rollers for positioning said sets of rollers above the support surface of said second means in horizontal alignment with the recessed portions of the stack and when said sets of rollers are in the second position for moving said second means relative to said set of rollers for placing the downwardly facing surfaces in the recessed portions in contact with said sets of rollers and moving said sets of rollers relative to the downwardly facing surfaces for fitting the hood into engagement with the downwardly facing surfaces of the recessed portions.

2. Apparatus, as set forth in claim 1, including third means for supplying cooling air to the working station for facilitating the cooling of the foil hood as the hood is pressed into the recessed portions of the stack.

3. Apparatus, as set forth in claim 2, wherein said second means comprises a first conveyor having a first end and a second end and including said generally horizontal stack supporting surface for receiving the stack in the working station with the stack being movable onto the stack mounting surface in the direction between the first and second ends of the first conveyor, and a frame extending laterally along both sides of said first conveyor and upwardly above said first conveyor so that said first conveyor can be displaced generally vertically within said frame, and said conveyor arranged to be moved vertically into at least three vertically spaced generally horizontal planes including a first horizontal plane positioned for receiving a stack from said first means.

4. Apparatus, as set forth in claim 3, wherein said first means comprises a pair of second conveyors each located adjacent one of the first and second ends of said first conveyor so that said first conveyor is located between said second conveyors with said second conveyors arranged to move a multi-layered stack into and out of the working station formed by said first conveyors.

5. Apparatus, as set forth in claim 1 or 3, wherein said two sets of rollers comprises one said set located at the first end of said first conveyor and the other said set located at the second end of said first conveyor, so that the stack is moved over the one of said sets of rollers onto said first conveyor, the axes of said sets of rollers being disposed horizontally and transversely of the direction of movement between said first and second ends of said first conveyor with the crowns of the rollers being located approximately in the same horizontal plane as the first horizontal plane of said first conveyor so that said rollers co-operate in the movement of the stack onto said first conveyor.

6. Apparatus, as set forth in claim 5, wherein said first conveyor being movable vertically downwardly from the first horizontal plane to a second horizontal plane and to a third horizontal plane located below the second horizontal plane, the second horizontal plane being located at least below the lowermost surface of said sets of rollers.

7. Apparatus, as set forth in claim 6, wherein said sets of rollers each being movable along a rectilinear generally horizontal path toward and inwardly over the stack supporting surface on said first conveyor when the stack mounting surface is in the second horizontal plane for effecting contact by each said set of rollers with the surfaces in the recessed portions of the stack.

8. Apparatus, as set forth in claim 3, wherein said third means comprises air supply members mounted on said frame, said air supply members having adjustable air slots for regulating the flow of air toward the stack mounted on said stack supporting surface of said conveyor so that the flow of air can be provided while said sets of rollers are moved into the recessed portions of the stack.

9. Apparatus, as set forth in claim 8, wherein said frame comprises a pair of inverted U-shaped members each located outwardly from a different side of said conveyor which side extends in the direction between the first and second ends of said first conveyor.

10. Apparatus, as set forth in claim 9, wherein said U-shaped members comprise upright supports extending upwardly from below said third horizontal plane to above said first horizontal plane of said first conveyor and horizontal supports interconnecting the upper ends of said upright supports, said air supply members positioned on said upright supports and horizontal supports of said U-shaped member for directing air toward the stack mounted on said stack supporting surface of said first conveyor.

11. Apparatus, as set forth in claim 10, including air supply conduit means located below said third horizontal plane of said first conveyor and connected to said air supply members on said frame for supplying air thereto.

12. Apparatus, as set forth in claim 4, wherein said two sets of rollers comprises one set located between the first end of said first conveyor and the adjacent end of one of said second conveyors and the other said set located between the second end of said first conveyor and the adjacent end of the other one of said second conveyors, said sets of rollers arranged to support the stack as it is moved onto and off said first conveyor from and to said second conveyors, the axes of said sets of rollers being disposed horizontally so that the crowns of said rollers are located in approximately the same horizontal plane as the first horizontal plane of said first conveyor so that said sets of roller cooperate in the movement of the stack onto and off said first conveyor.

* * * * *